US006170669B1

(12) United States Patent
Senior et al.

(10) Patent No.: US 6,170,669 B1
(45) Date of Patent: Jan. 9, 2001

(54) SEPARATION OF MINERALS

(75) Inventors: Geoffrey David Senior, Brighton East (AU); Raimo Ilmari Ahveninen, Espoo (FI)

(73) Assignee: The Commonwealth of Australia Commonwealth Scientific and Industrial Research Organization (AU)

( * ) Notice: Under 35 U.S.C. 154(b), the term of this patent shall be extended for 0 days.

(21) Appl. No.: 09/107,290

(22) Filed: Jun. 30, 1998

(51) Int. Cl.[7] ..... B03D 1/02
(52) U.S. Cl. ..... 209/166; 209/167
(58) Field of Search ..... 209/166, 167

(56) References Cited

U.S. PATENT DOCUMENTS

| | | | |
|---|---|---|---|
| 5,372,726 | | 12/1994 | Straten . |
| 5,411,148 | * | 5/1995 | Kelebek et al. . |
| 5,439,115 | * | 8/1995 | Beyzavi . |

FOREIGN PATENT DOCUMENTS

| | | |
|---|---|---|
| 38199/85 | 8/1985 | (AU) . |
| 69283/87 | 2/1990 | (AU) . |
| 24911-92 | 8/1995 | (AU) . |
| 2151316 | 12/1996 | (CA) . |
| 96/01150 | 1/1996 | (WO) . |

* cited by examiner

*Primary Examiner*—Thomas M. Lithgow
(74) *Attorney, Agent, or Firm*—Sughrue, Mion, Zinn, Macpeak & Seas, PLLC

(57) ABSTRACT

A process for floating fine particles containing metal values of an iron-bearing sulphide mineral ore including the steps of conditioning the aqueous pulp of ore at a pH of between about 7 and about 10 with a reducing agent which is preferably oxy-sulphur compound which dissociates to form oxy-sulphur ions having the general formula:

$$S_nO_y^{z-}$$

where n is greater than 1; y is greater than 2; and z is the valance of the ion.

A suitable collector is then added to the conditioned aqueous pulp to further condition the pulp and the pulp potential of the pulp raised to a sufficient level for the collector to adsorb onto the sulphide mineral ore. Gas is then bubbled through the aqueous pulp to subject the pulp to froth flotation. The froth from the flotation process is recovered to produce a concentrate of fine sulphide mineral and other metal values.

By conditioning the aqueous pulp at a pulp potential which dissolves the iron hydroxide film from the surface of the metal sulphide inclusions in the ore and subjecting the ore to froth flotation at a suitable pulp potential before the iron hydroxide can reform, the recovery of metal values in the fine ores can be greatly enhanced.

20 Claims, 2 Drawing Sheets

SEPARATION OF MINERALS

FIELD OF THE INVENTION

This invention relates to beneficiation of ores and, more particularly, to a process for enhancing the floatability of iron-bearing sulphides while leaving other sulphides and non-sulphides unfloatable.

BACKGROUND OF THE INVENTION

In many parts of the world, valuable metals such as gold, nickel and platinum group metals (PGM's) occur in iron-bearing sulphides such as pentlandite, pyrrhotite and arsenopyrite. These minerals are recovered selectively from the ores by flotation. While flotation is a remarkably efficient process, one of its most significant limitations for iron-bearing sulphides is that fine particles are not recovered efficiently and a great deal of fine valuable sulphides are lost to the tailings. For example, for pentlandite which is a nickel-iron sulphide it is not unusual for as much as half the nickel which fails to float in a nickel concentrator to be less than 10 $\mu$m in size. The improvement of fine particle recovery has been the subject of a great deal of research, much of which has focussed on the use of different types of flotation cells such as column cells.

OBJECT AND SUMMARY OF THE INVENTION

It is an object of the present invention to provide a process for improving the recovery of metal values preferably contained in ores having a fine particle size.

It has now been found that a major reason iron-bearing sulphides float poorly at fine sizes is that their surfaces are oxidised and to a large extent covered by an iron hydroxide film which renders them poorly floatable with conventional sulphide flotation reagents. It is the applicants opinion that these iron hydroxide films present in iron-bearing sulphide systems consist of ferric hydroxide. A process has been devised by the applicants that strips this surface film for a time sufficient to allow collectors to adsorb. Surprisingly the method is efficient at the pH values typically used in sulphide flotation (pH 7 to 10), a result which would not be predicted by current knowledge. The process involves a complex series of reactions each with different kinetics and it is an understanding of these kinetics that permits the improved separations.

Accordingly, the invention provides a flotation process for the separation of iron-bearing sulphide containing ores including the steps of (a) conditioning an aqueous pulp of iron-bearing sulphide containing ores with an oxy-sulphur compound said pulp having a pH of between about 7 and about 10, to a level to modify an iron hydroxide film on the surface of said iron-bearing sulphides in said ores (b) adding a collector to said conditioned aqueous pulp, (c) raising the pulp potential to a level sufficient for the collector to adsorb onto the surface of the sulphide ore, (d) bubbling gas through said aqueous pulp and thereby subjecting the aqueous pulp to froth flotation to produce a froth containing said sulphide containing ores, and (e) recovering said froth to obtain a concentrate relatively rich in the sulphide containing ores.

The process of the invention is particularly useful in recovering metal values contained in metal bearing iron sulphide mineral ores in a size fraction which is below a critical particle size where conventional floatability decreases. Ores having a particle size below such a critical size usually constitute the tailings of conventional primary flotation processes.

As would be appreciated by those skilled in the art, the critical size is system dependant and will generally vary greatly depending on the assay of the mineral ores being processed and the type and quantity of collectors used.

The process of the invention is particularly useful for recovering metal values from sulphide ores in which the ore particles have metal bearing iron sulphide mineral inclusions preferably less than 20 $\mu$m in size and most preferably less than 10 $\mu$m, these being the typical size found in the tailings of a primary separation. The process of the invention may be used for floating particles having such inclusions, the size of the ore particles being as much as 130 $\mu$m.

To modify the iron hydroxide film on the surface of the metal sulphides to enable a collector to adsorb onto the surface thereof, it is preferable that the reducing agent condition the pulp to a pulp potential, $E_h$ in accordance with the following formulae within a practical period of time:

$$E_h=0.271-0.059pH^*$$

where pH* is the pH of the conditioned pulp,
and $E_h$ is the pulp potential (Standard Hydrogen Electrode) (SHE) in Volts.

It is preferable for the $E_h$ to reach this level within a practical limit of 10 minutes.

There are very few reducing agents which are able to reduce the pulp potential below the required level to modify the ferric hydroxide film on the surface of the metal sulphide minerals within a practical time limit.

The preferred reducing agents capable of reducing the pulp potential below the required level are oxy-sulphur compounds which dissociate in the aqueous media to form oxy-sulphur ions having the general formulae:

$$S_nO_y^{z-}$$

where n is greater than 1; y is greater than 2; and z is the valance of the ion.

The oxy-sulphur compound is preferably dithionite which both brings about the necessary reducing conditions and reacts with the iron hydroxide films. Other combinations of reducing reagents which may include oxy-sulphur compounds that reduce the ferric hydroxide film may be used.

Once the pulp has been conditioned with sufficient collector to float the sulphides, the pulp potential is then raised to cause the collector to adsorb onto the iron-bearing sulphides thereby rendering these sulphides strongly floatable. However the effect may not be sustained for any extended period of time because the ferric hydroxide films reform under the oxidising conditions needed for sulphide flotation. Nevertheless, by arranging the flotation equipment appropriately, and repeating the process if necessary, a great deal of additional fine valuable sulphide mineral can be recovered.

The features, objects and advantages of the present invention will now become more apparent from the following description of the preferred embodiment and accompanying drawings in which:

DETAILED DESCRIPTION OF THE INVENTION

Figure 1:
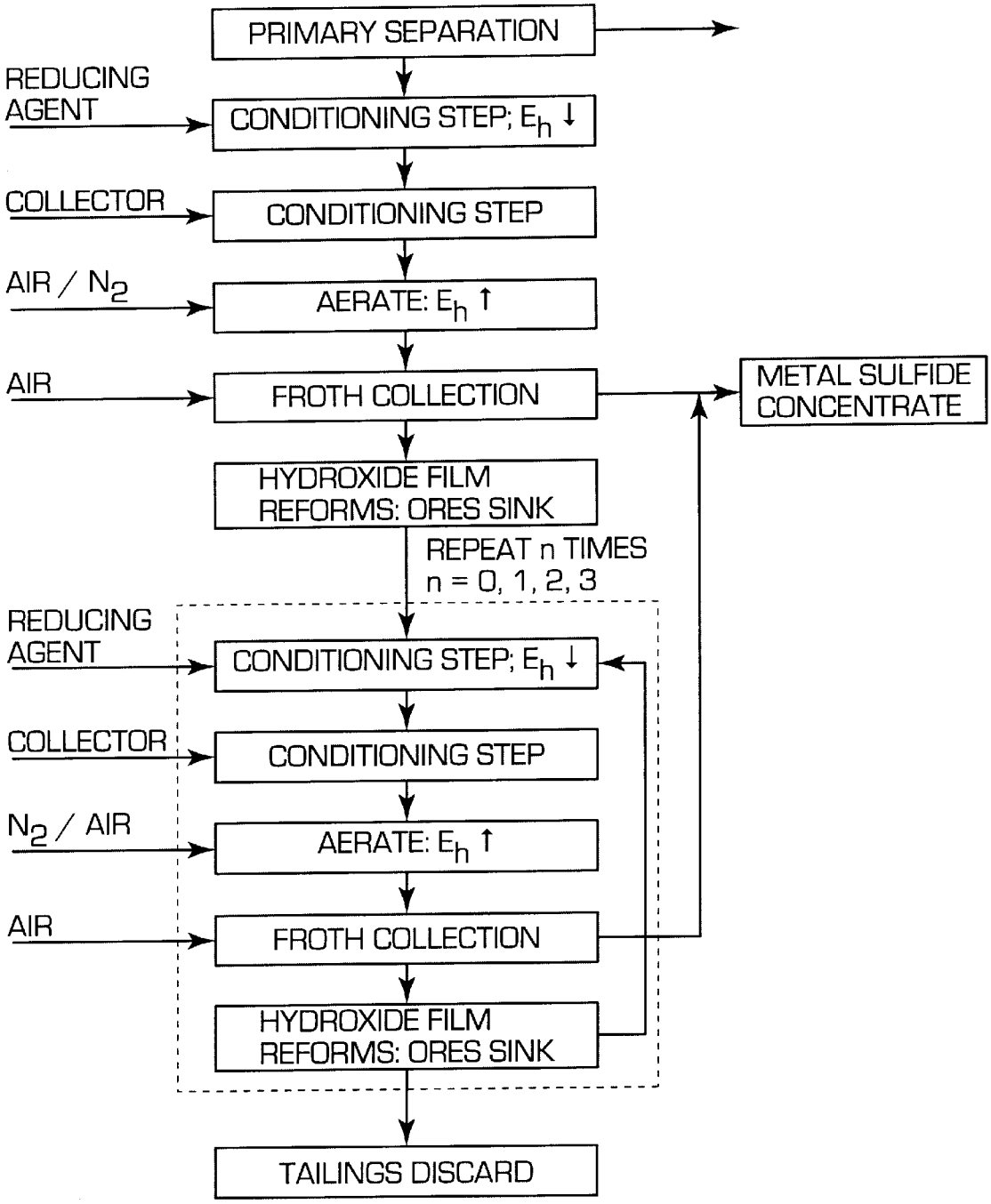
FIG. 1 is a schematic flow diagram in accordance with the invention.

Referring to the diagram in FIG. 1, mineral ore containing iron-bearing sulphides such as tailings from a primary separation are formed into an aqueous pulp and conditioned using a reducing agent. The metal containing iron sulphide mineral inclusions in the ore preferably have a particle size of less than 20 microns and more preferably less than 10 microns. The particle size of the ore containing the inclusions is system dependent with particles as large as 130 microns being rendered floatable.

Figure 2:
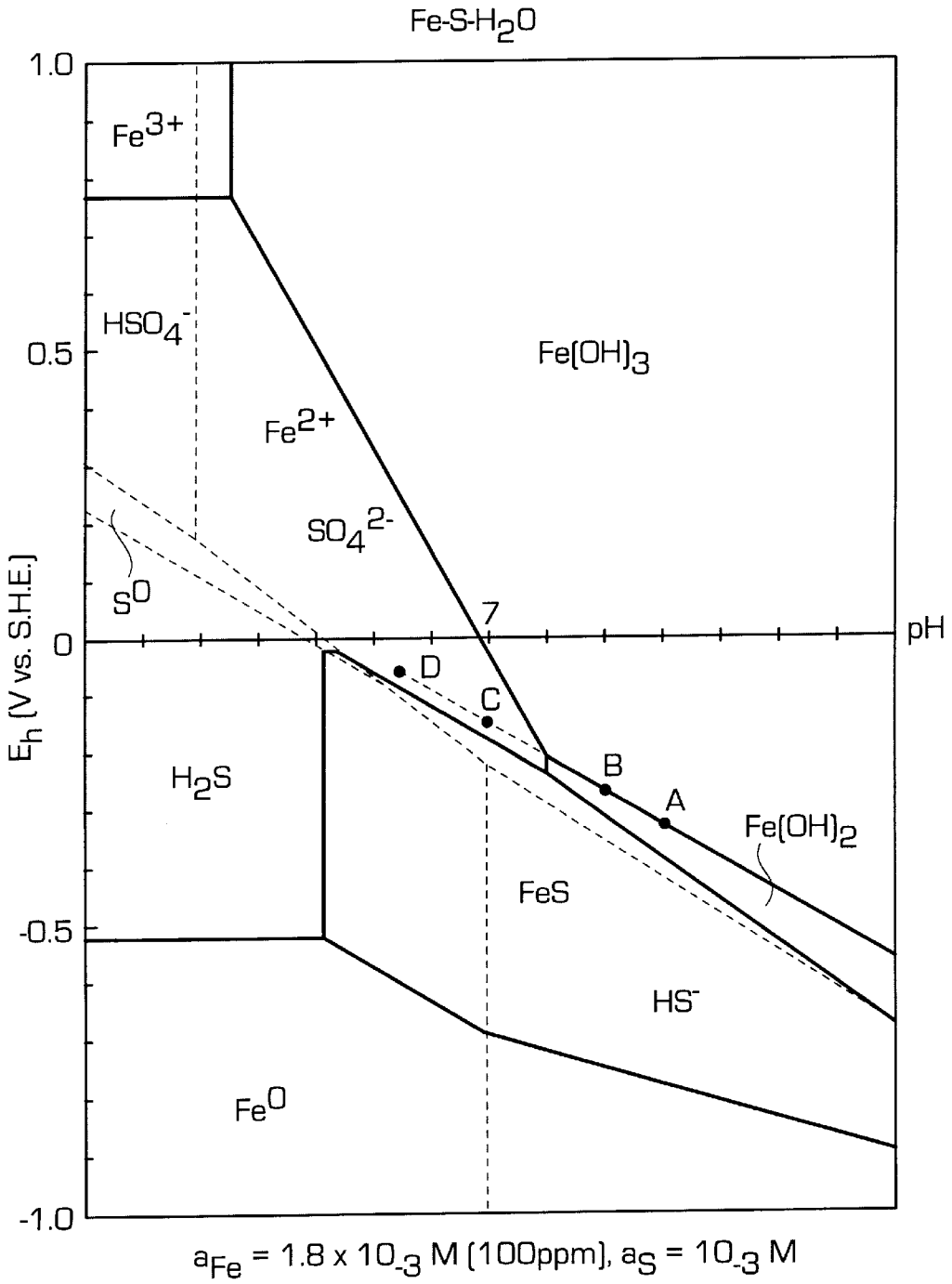
FIG. 2 is a pulp potential—pH stability diagram for the Fe—S—$H_2O$ system.

The pulp is conditioned with the reducing agent for a time sufficient to reduce the pulp potential below a critical level where the ferric hydroxide film is reduced. As shown in FIG. 2 for a Fe—S—$H_2O$ system at 25°, the critical pulp potential is determined by the formulae:

$$E_h=0.271-0.059pH^*$$

where pH* is the pH of the reduced system; and $E_h$ is the pulp potential (SHE) in Volts.

It is desirable for the pH of the aqueous pulp, prior to conditioning, to be in the range of 7 to 10. Once the reducing agent is added to the aqueous pulp, the pH of the system may vary outside this range thereby effecting the critical pulp potential below which the pulp must be reduced.

Unless controlled, it is conceivable that the pH can drop as low as 5.5. At this pH level, the critical pulp potential is below −53 mV. However for more typical pulp pH levels of 7, 9 and 10, the critical pulp potential, below which the ferric hydroxide film is reduced, is −142 mV, −260 mV, and −319 mV respectively. However, in most practical applications, excess reducing agent is preferably added to ensure that the pulp potential is reduced sufficiently below the critical pulp level to ensure that the ferric hydroxide film is reduced.

To satisfy the thermodynamic requirements of the system, it is preferable for the reducing agent to reduce the pulp potential below the critical level within a time period of about 10 minutes and preferably less than 5 minutes. There are very few reducing agents capable of satisfying these requirements and it is preferred that the reducing agent is an oxy-sulphur compound which dissociates in an aqueous system to form oxy-sulphur irons.

The oxy-sulphur agent preferably used in the invention disassociates to form oxy-sulphur ions having the general formulae:

$$S_nO_y^{z-}$$

where n is greater than 1; y is greater than 2; and z is the valance of the ion.

Oxy-sulphur ions which fall within this general formulae include dithionite and tetrathionate.

Usually it is desirable that the pulp be agitated continuously in contact with the reducing agent, that air be excluded during conditioning to avoid re-oxidation of the iron hydroxide film, and that the conditioning be allowed to continue for a sufficient period preferably less than 10 minutes and more preferably between 4–5 minutes before collector is added to the system.

The extent to which the pulp needs to be reduced and the quantity of the oxy-sulphur reagent which needs to be contacted with the pulp in order to achieve sufficient removal of ferric hydroxide films is largely dependent on the extent of formation of such films and on the composition of the pulp and the reagent itself. With any given pulp it is, of course, possible to determine by trial and experiment the quantity of reductant which needs to be contacted with the pulp. In the case in which the reductant and oxy-sulphur reagent is dithionite, preferably the dithionite is added in sufficient quantity to achieve a pulp potential of −400 mV on the standard hydrogen electrode (SHE) scale. More generally, the quantity of oxy-sulphur reagent added is about 0.5 to 2 kg per tonne (metric tonne) of the ore undergoing treatment. In some cases, the conditioning is conducted on a pulp formed from tailings from which an initial concentrate has been separated e.g. a cleaner tailings. Since the quantity of such tailings might be small by comparison with the fresh feed, the preferred quantity of reagent may be considerably less than 0.5 to 2 kg based on a feed of 1 tonne of solids in the pulp undergoing conditioning.

After the pulp has been conditioned with the reducing agent for a period of less than 10 minutes, a collector is added to the pulp. Since the ferric hydroxide films on the iron sulphide minerals have been reduced, the collector is able to adsorb onto the surface of the iron sulphide minerals after a collector conditioning step which generally takes about 5 minutes depending on the collector.

The collector employed in the flotation process may be any collector effective to bring about flotation of sulphide minerals. Examples of suitable collectors include xanthates, dixanthogen, xanthate esters, dithiophosphates, dithiocarbamates, thionocarbamates, and mercaptans.

As noted above, the way in which the pulp potential is raised after conditioning is important. The potential needs to be raised above the threshold value for the collector to adsorb and to bring about flotation, but not in a way that brings about rapid reformation of the iron hydroxide. In this respect, we have found it advantageous to use a mixture of gases for flotation, in particular a 50/50 vol % mixture of nitrogen and air to raise the pulp potential. The use of such gases also has the added advantage that any naturally floatable minerals present, such as talc or graphite, can be removed in a pre-flotation step before the potential rises above the threshold potential for sulphide flotation.

As noted previously, the iron hydroxide films reform reasonably quickly and it is therefore important to arrange the conditions so that the sulphides float as rapidly as possible. In general, the period of strong flotation lasts about 10 minutes. In its preferred form, the process should be conducted in a type of flotation cell that gives intimate contacting of particles with bubbles and high rates of genuine flotation. Designs such as Column cells, Jameson cells, Turbo-flotation cells and air sparged hydrocyclones might generally be preferred over conventional mechanically agitated cells, provided they are operated with low effective water recoveries, preferably less than 20.

Because of the tendency of the iron hydroxides to reform, it may be beneficial to repeat the process with successive additions of reagents and collector and to combine the concentrate from each flotation stage to obtain a final concentrate. In continuous processing, such staged flotation may be conducted in a plurality of successive conditioning and flotation cell stages to which reductant, or oxy-sulphur reagent and collector are added, and wherein the tailings from each cell are passed to the succeeding cell, and the froth concentrates from the various stages combined. In addition, selected streams or selected portions of streams might be separated from the tailings and recirculated for further treatment.

For ore types with fine textures, additional grinding might be needed before the metal-containing, iron sulphide are liberated and the process can be applied successfully. A particular advantage of the process is that it can be used to treat ores re-ground to fine sizes, including those re-ground in mills with iron media. Abrasion and corrosion of iron media contributes additional iron to the system which would normally tend to suppress flotation. In overcoming the effects of precipitated iron, the process of the invention allows ores to be ground to finer sizes using inexpensive media such as mild steel.

The process will now be described in more detail by way of example:

COMPARATIVE EXAMPLE 1

The feed is from a sulphide deposit and contains the iron sulphides, pyrrhotite, pyrite, pentlandite, violarite, and chalcopyrite. In total, these iron sulphides account for about 15 percent of the sample by weight with pyrrhotite and pentlandite being present in the greatest amounts. The rest of the sample is primarily non-sulphide gangue comprising, amongst other things, minerals of the serpentine group and a small amount of talc. The head assay is 2.2% Ni, 0.15% Cu, 5.60% S and 11.0% Fe.

The ore was ground for 50 minutes using a rod mill/ball mill combination and mild steel media to give a very fine size of 80% passing 10 $\mu$m. The ground sample was slurried with water to form a feed slurry or pulp for froth flotation processing having a solids content of 45 wt % solids. The pH of this pulp was 8.8. A series of reference tests using conventional sulphide flotation procedures was then conducted to determine the separations that such procedures could produce. A range of collectors and gangue depressants was tested, as was the addition of copper sulphate and the inclusion of a talc pre-float. In general, nickel and sulphur recoveries could not be raised much above 30 percent without a significant loss of selectivity against non-sulphides and a concomitant loss of concentrate grade. A typical result for a test with acceptable selectivity—more than 3.5% Ni and less than 10% MgO in the concentrate—is given in Table 1:

TABLE 1

Result using conventional flotation methods.

| Stage | | Component (%) | | | | |
|---|---|---|---|---|---|---|
| | | S | Ni | Cu | Fe | MgO |
| Sulphide Con | A | 9.20 | 3.71 | 0.61 | 13.8 | 7.60 |
| (standard float) | R | 32.5 | 33.9 | 83.5 | 24.8 | 30.7 |

A - assay; R - recovery;

For this test, the pulp was floated at its natural pH (pH 8.8) using standard equipment and 170 g/t of amyl xanthate as collector and 200 g/t of sodium hexametaphosphate as gangue depressant. The pulp was conditioned with collector for 2 minutes and with gangue depressant for 8 minutes. The frother was commercially available Cyanamid Aerofroth 65 containing polypropylene glycol added as required.

EXAMPLE 1

After the reference tests had been conducted, the flotation procedure used in the comparative Example 1 was repeated except that the process pulp was conditioned in accordance with invention before flotation. Thus sufficient sodium dithionite was added to lower the pulp potential to −400 mV (SHE) and the pulp was conditioned for 5 minutes under nitrogen. The gas was then turned off and collector was added and conditioned for 2 minutes. The flotation gas at a rate of 8 l/min was then changed to a mixture of 50/50 vol % nitrogen and air and the pulp potential raised to a value above the threshold for xanthate adsorption (approximately, 150 mV SHE in this system). Once above this threshold the sulphides floated strongly and a series of concentrates were collected. The results using the new process are compared with those using the conventional method in Table 2:

TABLE 2

Comparison of results for tests with and without the new conditioning process.

| Method | | Component (%) | | | | |
|---|---|---|---|---|---|---|
| | | S | Ni | Cu | Fe | MgO |
| Conventional | A | 9.20 | 3.71 | 0.61 | 13.8 | 7.60 |
| | R | 32.5 | 33.9 | 83.5 | 24.8 | 30.7 |
| New Process | A | 12.7 | 4.77 | 0.37 | 20.3 | 4.54 |
| | R | 85.8 | 82.3 | 95.4 | 70.2 | 33.9 |

To determine when the potential was in a range suitable for flotation a battery operated millivolt meter connected to a platinum electrode and a silver/silver chloride reference electrode was used. In practice any one of a number of electrode types might be used including commercially available Oxygen-Reduction Potential (ORP) electrodes or mineral electrodes.

It can be seem from Table 2 that by conditioning the tailings stream with a suitable conditioner of a pulp potential of less than −400 mV (SHE), the recovery of metal values such as nickel and copper are greatly enhanced.

The conditions employed in the flotation, and in the other flotations described herein, may be those of conventional flotation processes and the details of such conditions, for example, as to solids contents, rates of bubbling etc., are well known to those skilled in the art and need not be described herein. Other conditions that may be employed such as those in the conditioning steps, for example solids content of the pulp, intensity of and forms of agitation, may be as employed in conventional conditioning processes as well known to those skilled in the art and again need not be described herein in detail.

It would also be appreciated that the process of the invention while applicable to nickel/iron sulphides is equally applicable to other metals such as gold and platinum group metals occurring in iron-bearing sulphide ores. The process of the invention can be easily adapted to these other metal values by using an appropriate reducing agent to adjust the pulp potential to a level under a reducing atmosphere where any ferric hydroxide film on the metal/iron sulphide inclusions is solubilised to allow the collector to adsorb onto the metal/iron sulphide mineral ore when the pulp potential is raised to a suitable level for adsorption.

What is claimed is:

1. A flotation process for the separation of iron-bearing sulphides containing ores including the steps of:

(a) conditioning under a reducing atmosphere an aqueous pulp of ores of metal-containing iron sulphide mineral having a particle size of less than 20 microns, said pulp having a pH of between about 7 and about 10 with an oxy-sulphur compound for a predetermined period, said oxy-sulphur compound dissociating to form oxy-sulphur ions having the general formula:

$$S_nO_y^{z-}$$

when n is greater than 1; y is greater than 2; and z is the valance of the ion, (b) adding a collector to said conditioned aqueous pulp, (c) raising the pulp potential of the pulp to a level sufficient for the collector to adsorb onto the sulphide ore, (d) bubbling gas through said aqueous pulp and thereby subjecting the aqueous pulp to froth flotation to produce a froth containing said ores of iron sulphide mineral, and (e) recovering said froth to obtain a concentrate of sulphide containing ores.

2. The flotation process according to claim 1 wherein the aqueous pulp of step (a) is conditioned by said oxy-sulphur compound below a pulp potential $E_h$ in accordance with the following formulae:

$$E_h=0.271-0.059pH^*$$

where pH* is the pH of the conditioned pulp; and $E_h$ is the pulp potential (SHE) in Volts of the conditioned pulp.

3. The flotation process according to claim 1 wherein the addition of the oxy sulphur compound reduces the pulp potential of the pulp to less than −400 mV (SHE).

4. The flotation process according to claims 1 or 2 wherein the oxy-sulphur compound is dithionite.

5. The flotation process according to claim 4 wherein 0.5 to 10 kg of the oxy-sulphur compound is added per tonne of ore being treated.

6. The flotation process according to claim 1 further including the step of (f) repeating steps (a) to (e) on the pulp remaining from step (e).

7. The flotation process according to claim 1 wherein the collector added in step (b) is selected from the group including xanthates, dixanthogen, xanthate esters, dithiophosphates, dithiocarbamates, thionocarbamates and mercaptans.

8. The flotation process according to claim 1 wherein the collector is amyl xanthate.

9. The flotation process according to claim 1 wherein the pulp potential of the pulp in step (c) is raised to above −150 mV.

10. The flotation process according to claim 1 wherein the pulp of step (a) is conditioned with the oxy-sulphur compound for at least 2 minutes.

11. The flotation process according to claim 1 wherein the flotation gas is a mixture of nitrogen and oxygen.

12. The flotation process according to claim 1 wherein the ore includes metal sulphides containing metals selected from the group consisting of nickel, gold and platinum group metals.

13. The flotation process according to claim 1 wherein the particles of metal-containing iron sulphide mineral contains nickel sulphide.

14. A flotation process for the separation of iron-bearing sulphide containing ores including the steps of:

(a) conditioning an aqueous pulp of ores comprising metal containing iron sulphide minerals said pulp having a pH of between 7 and 10 with a reducing agent to reduce the pulp potential to below a level of $E_h$ in accordance with the following formulae:

$$E_h=0.271-0.059pH^*$$

where pH* is the pH of the conditioned pulp; and $E_h$ is the pulp potential (SHE) in volts of the conditioned pulp, (b) adding a collector to said conditioned pulp, (c) raising the pulp potential to a level sufficient for the collector to adsorb onto the surface of said sulphide ore, (d) bubbling gas through said aqueous pulp and thereby subjecting the aqueous pulp to froth flotation to produce a froth containing said iron sulphide minerals, and (e) recovering said froth to obtain a concentrate relatively rich in the sulphide containing ores.

15. The process of claim 14 wherein said iron sulphide minerals in said aqueous pulp have a particle size of less than 10 $\mu$m.

16. The process of claims 14 wherein the reducing agent conditions the pulp potential to $E_h$ within a predetermined period.

17. The process of claim 14 wherein the reducing agent is an oxy-sulphur compound which dissociates to form oxy-sulphur ions having the general formulae:

$$S_nO_y^{z-}$$

where n is greater than 1; y is greater than 2; and z is the valance of the ion.

18. The process of claim 17 wherein the reducing agent is dithionite.

19. The process of claim 14 wherein said iron sulphide minerals in said aqueous pulp have a particle size of less than 20 $\mu$m.

20. The process of claim 19 wherein the ores containing said iron sulphide minerals have a particle size of less than 130 $\mu$m.

* * * * *